US009162838B2

(12) United States Patent
Hashimoto

(10) Patent No.: US 9,162,838 B2
(45) Date of Patent: Oct. 20, 2015

(54) SHEET CONVEYING APPARATUS AND IMAGE FORMING SYSTEM

(71) Applicant: Tsubasa Hashimoto, Kanagawa (JP)

(72) Inventor: Tsubasa Hashimoto, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 62 days.

(21) Appl. No.: 14/079,732

(22) Filed: Nov. 14, 2013

(65) Prior Publication Data

US 2014/0138217 A1 May 22, 2014

(30) Foreign Application Priority Data

Nov. 19, 2012 (JP) ..... 2012-253701

(51) Int. Cl.

| | |
|---|---|
| ***B65H 39/00*** | (2006.01) |
| ***G03G 15/00*** | (2006.01) |
| ***G06F 7/00*** | (2006.01) |
| ***B65H 29/12*** | (2006.01) |

(52) U.S. Cl.

CPC ..... *B65H 29/125* (2013.01); *B65H 2404/14* (2013.01); *B65H 2513/10* (2013.01); *B65H 2513/20* (2013.01); *B65H 2513/514* (2013.01); *B65H 2555/25* (2013.01); *B65H 2555/26* (2013.01); *B65H 2801/27* (2013.01)

(58) Field of Classification Search

USPC ..... 198/459.8, 460.1, 461.1; 271/3.18, 271/4.02, 4.03, 10.04, 287, 288; 270/58.01, 270/58.02, 58.03, 30.04

See application file for complete search history.

(56) References Cited

U.S. PATENT DOCUMENTS

| | | | | |
|---|---|---|---|---|
| 4,211,483 | A * | 7/1980 | Hannigan et al. | 399/85 |
| 4,229,100 | A * | 10/1980 | Travis | 355/77 |
| 4,285,591 | A * | 8/1981 | Botte et al. | 399/382 |
| 5,003,485 | A * | 3/1991 | Francisco | 700/221 |
| 5,187,587 | A * | 2/1993 | Farrell et al. | 358/296 |
| 5,826,869 | A * | 10/1998 | Nyffenegger et al. | 270/52.02 |
| 5,903,284 | A * | 5/1999 | Sato | 346/134 |
| 6,047,812 | A * | 4/2000 | Horn et al. | 198/781.06 |
| 6,792,332 | B1 * | 9/2004 | DePoi | 700/213 |
| 6,897,625 | B2 * | 5/2005 | Brixius et al. | 318/69 |
| 7,263,328 | B2 * | 8/2007 | Asai et al. | 399/408 |
| 7,548,721 | B2 * | 6/2009 | Isozaki | 399/388 |
| 7,681,883 | B2 * | 3/2010 | DeGruchy | 271/298 |
| 7,684,064 | B2 * | 3/2010 | Kimura et al. | 358/1.14 |
| 8,317,182 | B2 * | 11/2012 | Probst | 270/52.18 |
| 2010/0207314 | A1 | 8/2010 | Hattori et al. | |
| 2011/0301005 | A1 | 12/2011 | Hattori et al. | |

FOREIGN PATENT DOCUMENTS

| | | |
|---|---|---|
| JP | 4486480 | 4/2010 |

* cited by examiner

*Primary Examiner* — Douglas Hess

(74) *Attorney, Agent, or Firm* — Harness, Dickey & Pierce, P.L.C.

(57) ABSTRACT

A sheet conveying apparatus includes: a first sheet conveying unit that conveys a sheet by a driving force of an asynchronous motor; a second sheet conveying unit that conveys a sheet by a driving force of a synchronous motor, wherein a sheet is transferred from one of the first sheet conveying unit and the second sheet conveying unit to the other one to convey the sheet; and an asynchronous-motor control unit that starts drive of the asynchronous motor at a drive start timing determined according to rotation information at a time of acceleration of the synchronous motor, at a time of starting sheet conveyance when a same sheet is conveyed by both the first sheet conveying unit and the second sheet conveying unit.

10 Claims, 10 Drawing Sheets

FIG.13

| CONVEYANCE SPEED | A | B |
|---|---|---|
| ADJUSTMENT VALUE Ad [ms] | 7 | 4 |

SHEET CONVEYING APPARATUS AND IMAGE FORMING SYSTEM

CROSS-REFERENCE TO RELATED APPLICATIONS

The present application claims priority to and incorporates by reference the entire contents of Japanese Patent Application No. 2012-253701 filed in Japan on Nov. 19, 2012.

BACKGROUND OF THE INVENTION

1. Field of the Invention

The present invention relates to a sheet conveying apparatus and an image forming system.

2. Description of the Related Art

This type of sheet conveying apparatus is sometimes used at the time of performing post-processing of a sheet discharged from an image forming apparatus such as a printer, a copying machine, or a printing machine through a plurality of sheet post-processing devices. As the post-processing device, for example, there can be mentioned a punching device that punches a sheet, a sheet binding device that binds a bundle of sheets by a stapler or the like, and a sorter/ejector that sorts sheets formed with images to a plurality of paper discharge trays and discharges the sheets. Such a sheet post-processing device is often unitized individually and is selectively installed in the image forming apparatus.

In an image forming system in which a plurality of sheet post-processing devices are installed, sheets are conveyed along a predetermined sheet conveyance path while being transferred between the sheet post-processing devices. In such an image forming system, sheets may be conveyed while a conveying force is applied simultaneously from two sheet post-processing devices. In this case, when the sheet conveyance speed of the two sheet post-processing devices is different from each other, sheets may be slackened or pulled depending on the speed difference, thereby causing a problem of damaging the sheets or jamming.

In order to solve the problem, Japanese Patent No. 4486480 discloses a sheet conveying apparatus that when the conveyance speed of two units (sheet post-processing devices) that transfer sheets is different from each other, synchronizes a change timing of the conveyance speed. Specifically, at the time of accelerating or decelerating the speed or start-stop between the two units, the sheet conveying apparatus synchronizes the two units so that the accelerated or decelerated rate and the accelerated or decelerated distance of the two units becomes equivalent. With this configuration, occurrence of excessive slackening or pulling is suppressed in the sheets conveyed over the two units.

In the sheet conveying apparatus described in Japanese Patent No. 4486480, sheet conveying means such as a conveyance roller pair that applies a conveying force to the sheet in each unit is driven by a stepping motor. In this manner, when a drive source of the sheet conveying means of each unit is a synchronous motor such as the stepping motor, a highly accurate rotation position (sheet position) control during acceleration or deceleration can be executed. Accordingly, a control such that excessive slackening or pulling does not occur in the sheet conveyed over the sheet conveying means of the both units is facilitated during acceleration or deceleration.

However, when an asynchronous motor such as a direct-current motor (DC motor), for which a highly accurate rotation position control is difficult, is adopted for one of the drive sources, it is difficult to control so that excessive slackening or pulling does not occur in the sheet conveyed over the sheet conveying means of the both units in an acceleration period or a deceleration period. More specifically, when the drive sources are both the asynchronous motor, the both motors have the same acceleration characteristics and deceleration characteristics. Therefore, by standardizing a drive start timing and a drive stop timing of the both motors, excessive slackening or pulling of sheets in the acceleration period and the deceleration period can be suppressed without executing any rotation position control. However, when one of the drive sources is the asynchronous motor and the other one is the synchronous motor, the acceleration characteristics and the deceleration characteristics of the both motors are considerably different. Therefore, when the standardized drive start timing or drive stop timing is used, excessive slackening or pulling of sheets occurs in the acceleration period and the deceleration period.

At this time, such a method can be considered that a rotation position of the synchronous motor in the acceleration period and the deceleration period is controlled according to the acceleration characteristics and the deceleration characteristics of the asynchronous motor, so that excessive slackening or pulling of sheets does not occur in the acceleration period and the deceleration period. Generally, however, even if the synchronous motor is accelerated so as to reach a target speed as soon as possible, the magnitude of acceleration of the synchronous motor is far less than that of the asynchronous motor. The same applies to the case of deceleration. Therefore, according to the method of controlling the rotation position of the synchronous motor, it is difficult to suppress occurrence of excessive slackening or pulling of sheets in the acceleration period and the deceleration period.

Therefore, it is desirable to provide a sheet conveying apparatus that can suppress occurrence of excessive slackening or pulling of a sheet conveyed over two sheet conveying units that respectively adopt a synchronous motor and an asynchronous motor, and an image forming system including the sheet conveying apparatus.

SUMMARY OF THE INVENTION is an object of the present invention to at least partially solve the problems in the conventional technology.

According to an aspect of the present invention, there is provided a sheet conveying apparatus including: a first sheet conveying unit that conveys a sheet by a driving force of an asynchronous motor; a second sheet conveying unit that conveys a sheet by a driving force of a synchronous motor, wherein a sheet is transferred from one of the first sheet conveying unit and the second sheet conveying unit to the other one to convey the sheet; and an asynchronous-motor control unit that starts drive of the asynchronous motor at a drive start timing determined according to rotation information at a time of acceleration of the synchronous motor, at a time of starting sheet conveyance when a same sheet is conveyed by both the first sheet conveying unit and the second sheet conveying unit.

According to another aspect of the present invention, there is provided a sheet conveying apparatus including: a first sheet conveying unit that conveys a sheet by a driving force of an asynchronous motor; a second sheet conveying unit that conveys a sheet by a driving force of a synchronous motor, wherein a sheet is transferred from one of the first sheet conveying unit and the second sheet conveying unit to the other one to convey the sheet; and an asynchronous-motor control unit that stops drive of the asynchronous motor at a drive stop timing determined according to rotation information at a time of deceleration of the synchronous motor, at a time of stopping sheet conveyance when a same sheet is conveyed by both the first sheet conveying unit and the second sheet conveying unit.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 13 is a table of an example an adjustment value at the conveyance speed A and an adjustment value at the conveyance speed B when paper is stopped at a certain punching position.

DETAILED DESCRIPTION OF THE PREFERRED EMBODIMENTS

Exemplary embodiments of the present invention are explained below.

Figure 1:
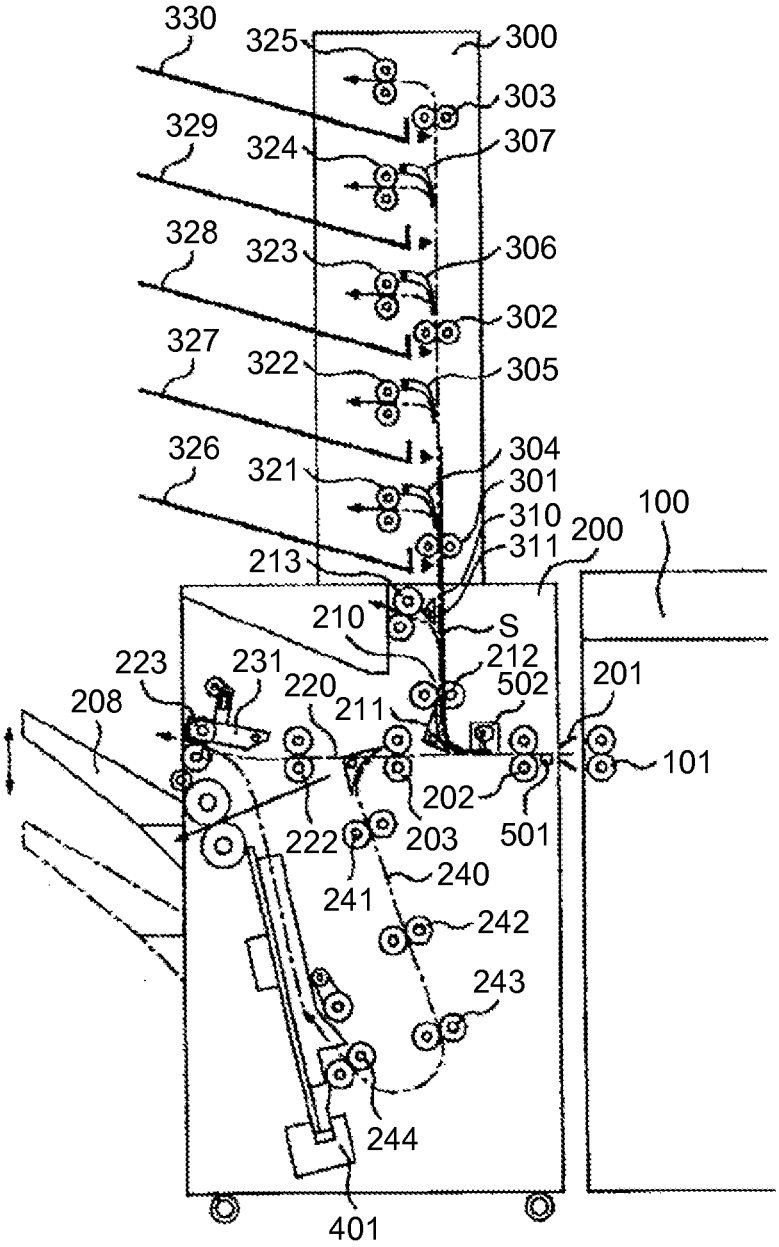
FIG. 1 is a schematic configuration diagram of a main part of an image forming system according to an embodiment of the present invention including a paper post-processing device.

FIG. 1 is a schematic configuration diagram of a main part of an image forming system according to an embodiment of the present invention including a paper post-processing device.

The image forming system mainly includes an image forming apparatus 100, and a paper post-processing device 200 as a sheet conveying apparatus and a mailbox 300. The paper post-processing device 200 is installed on a downstream side in a paper conveyance direction of the image forming apparatus 100, to perform post processing of paper conveyed from the image forming apparatus 100 such as discharge and stacking, punching (boring), binding, and bookbinding. On a further downstream side in the paper conveyance direction of the paper post-processing device 200, the mailbox 300 is provided. The mailbox 300 performs paper discharge and sorting, and is an independent unit that can be selectively attached to the paper post-processing device 200.

The image forming apparatus 100 according to the present embodiment is a general electrophotographic image forming apparatus, and the type thereof is not particularly limited so long as image are formed on paper S. Therefore, the image forming apparatus 100 can be, for example, an inkjet image forming apparatus or a form of a printing machine.

In the present embodiment, a case where the paper (paper formed with an image) S discharged from the image forming apparatus 100 is punched by a press punching device 502 of the paper post-processing device 200, and the punched paper is discharged to the mailbox 300 to be sorted and discharged is mainly explained.

The paper S discharged from the image forming apparatus 100 passes through an inlet guide plate 201 of the paper post-processing device 200, and is carried into the paper post-processing device 200 by an inlet roller pair 202. At least a part of paper conveyance drive in the paper post-processing device 200 according to the present embodiment is performed by a direct-current motor (DC motor), which is an asynchronous motor. When this is a synchronous motor such as a stepping motor, a paper conveying distance per pulse can be ascertained in control, and thus the position of the paper S in the conveying direction can be accurately controlled. However, because the synchronous motor is expensive, the manufacturing cost is increased. On the other hand, in the case of a DC motor, because the DC motor is inexpensive, reduction of the manufacturing cost can be achieved. Furthermore, because the acceleration characteristics and the deceleration characteristics of the DC motor can be ascertained in advance, even if the DC motor is used, the position in the conveying direction of the paper S can be controlled with sufficient accuracy required in the present embodiment.

The paper conveyance drive according to the present embodiment is divided into an inlet drive unit that drives the inlet roller pair 202, a conveyance drive unit that drives roller pairs 203, 212, and 213, a shift conveyance unit that drives a shift roller pair 222, a paper-discharge drive unit that drives a paper-discharge roller pair 223 to discharge paper to a paper discharge tray 208, and a lower conveyance drive unit that drives conveyance roller pairs 241, 242, and 243, and a tray discharge roller pair 244, and each drive unit can be driven independently. Reference sign 231 denotes an opening/closing lever that opens and closes at the time of a shift operation by the shift roller pair 222 so that the paper-discharge roller pair 223 does not hinder the shift operation of the paper S. The opening/closing lever 231 is provided with the paper-discharge roller pair 223 rotatably at a free end thereof, and is turnably supported by a spindle at a base end thereof.

The press punching device 502 is arranged on a downstream side in the paper conveyance direction of the inlet roller pair 202, to perform punching for each paper by stopping paper conveyance at a punching position (a position of the paper S shown in FIG. 1). An upper conveyance path 210 and a conveyance path 220 are a conveyance path when a binding process is not performed on the paper S. When the binding process is performed, the paper S is conveyed through a lower conveyance path 240 toward a binder (an end-face binding stapler) 401.

Figure 2:
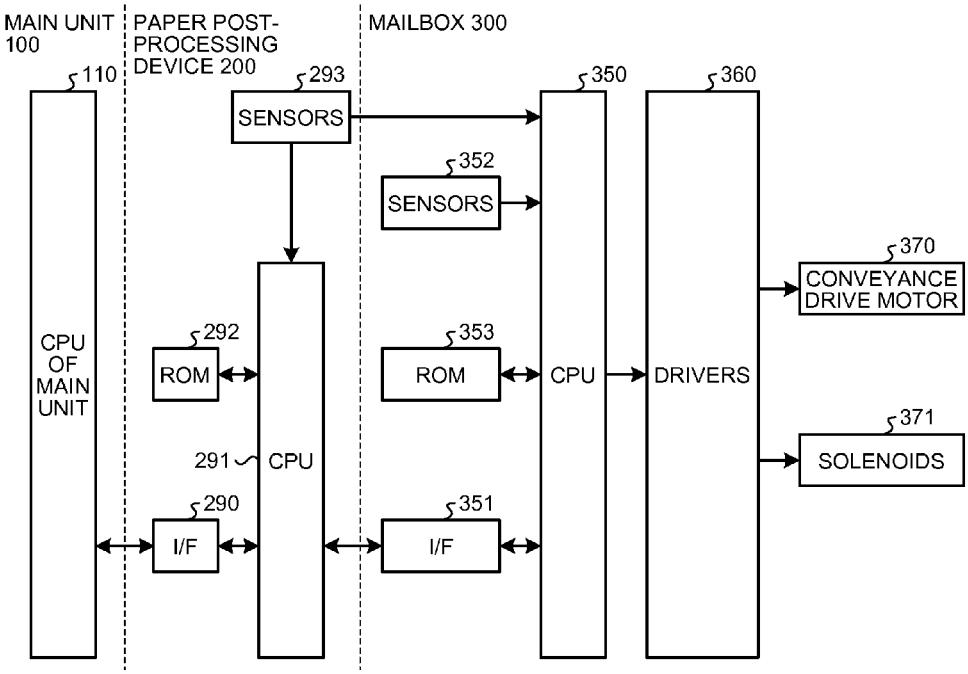
FIG. 2 is a block diagram of a system configuration of an image forming apparatus, a paper post-processing device, and a mailbox in the image forming system.

FIG. 2 is a block diagram of a system configuration of the image forming apparatus 100, the paper post-processing device 200, and the mailbox 300.

A CPU 110 of the image forming apparatus (main unit) 100 is connected to a CPU 291 of the paper post-processing device 200 via an interface 290 of the paper post-processing device 200. A ROM 292 that stores a program is connected to the CPU 291, and the CPU 291 executes processing according to the program stored in the ROM 292 while using a RAM (not shown) as a work area. Detection information from a plurality of sensors 293 of the paper post-processing device 200 is input to the CPU 291, and the CPU 291 sends instructions to a CPU 350 of the mailbox 300 via an interface 351 based on a detection input.

The mailbox 300 is controlled by the CPU 350. A ROM 353 that stores a program is connected to the CPU 350, and the CPU 350 executes processing according to the program stored in the ROM 353 while using a RAM (not shown) as a work area. Detection information from a plurality of sensors 352 provided in the mailbox 300 and detection information from the respective sensors 293 of the paper post-processing device 200 are input to the CPU 350, and the CPU 350 controls a conveyance drive motor 370 and solenoids 371 via a driver 360 based on an instruction from the paper post-processing device 200 and pieces of detection information from the sensors 293 and 352.

Figure 3:
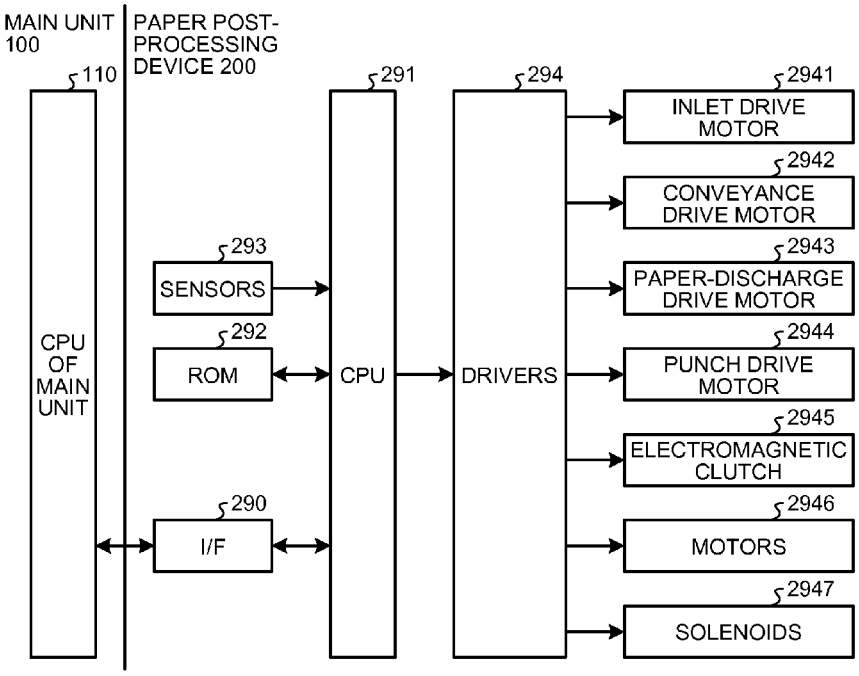
FIG. 3 is a block diagram of a system configuration of the image forming apparatus (main unit) and the paper post-processing device.

FIG. 3 is a block diagram of a system configuration of the image forming apparatus (main unit) 100 and the paper post-processing device 200.

As can be understood from FIG. 3, the CPU 291 of the paper post-processing device 200 drives an inlet drive motor 2941, a conveyance drive motor 2942, a paper-discharge drive motor 2943, a punch drive motor 2944, an electromagnetic clutch 2945, and other motors 2946 and a plurality of solenoids 2947 (both not mentioned above) via respective drivers 294. Among these elements, the inlet drive motor 2941 drives the inlet roller pair 202, the conveyance drive motor 2942 drives the conveyance drive unit and the lower conveyance drive unit (the roller pairs 203, 212, 213, 241, 242, 243, and 244). The paper-discharge drive motor 2943 drives the paper-discharge drive unit (the paper-discharge roller pair 223), and the punch drive motor 2944 drives the press punching device 502. Furthermore, although not shown in FIG. 1, the electromagnetic clutch 2945, the solenoids 2947, and the other motors 2946 provided in the paper post-processing device 200 are also driven by the CPU 291 via the respective drivers 294.

In the image forming system according to the present embodiment in which the respective units are configured in this manner, when a mode for discharging paper to the mailbox 300 is selected in an operating unit of the image forming apparatus 100, paper discharged from the image forming apparatus 100 passes through the inlet guide plate 201 of the paper post-processing device 200, and is carried into the paper post-processing device 200 by the inlet roller pair 202. The paper S passes through a branching claw 211 and the conveyance roller pair 212, and is conveyed to a conveyance path 310 to the mailbox 300 by a branching claw 311. The paper S is then discharged to any of paper discharge trays 326 to 330 and stacked therein by branching claws 304 to 307 and paper-discharge roller pairs 321 to 325.

Figure 4:
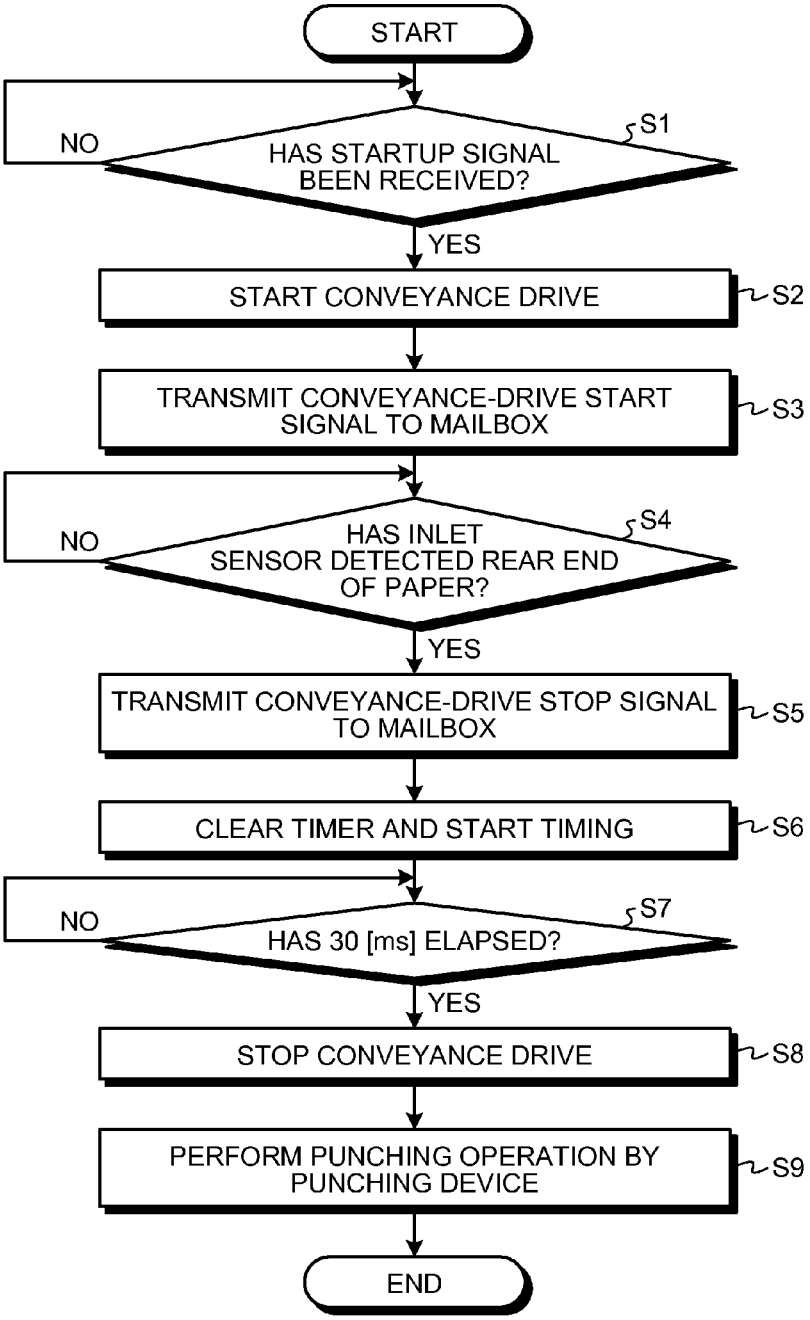
FIG. 4 is a flowchart of a control flow in the paper post-processing device until a punching process is performed on paper in the embodiment.

FIG. 4 is a flowchart of a control flow in the paper post-processing device 200 until a punching process is performed on the paper S.

Substantially simultaneously upon discharge of a front edge of the paper from a paper-discharge roller pair 101 of the main unit 100, a front-edge discharge signal (information indicating that the front edge of the paper passes through the paper-discharge roller pair 101 of the main unit 100) is transmitted from the main unit 100 to the paper post-processing device 200. Together with the information, information of the paper size, whether to perform punching and binding, and a paper discharge destination (the paper discharge tray number of the mailbox 300 or the like) is also transmitted from the main unit 100 to the paper post-processing device 200. The paper post-processing device 200 can ascertain based on the information whether to perform the punching process and to which paper discharge tray of the mailbox 300 the paper is to be discharged.

When the paper S is subjected to the punching process and then discharged to the mailbox 300, upon reception of a startup signal from the image forming apparatus 100 (Step S1), the paper post-processing device 200 is activated and prepares for receiving the paper S. Specifically, the paper post-processing device 200 starts conveyance drive of the respective drive units of the paper post-processing device 200 (Step S2). Accordingly, the respective drive units of the paper post-processing device 200 are driven at the same paper conveyance speed (for example, 360 [mm/s]) as that of the image forming apparatus 100 (hereinafter, "main unit" as appropriate). The paper conveyance speed of the main unit 100 can be ascertained by the paper post-processing device 200 based on speed information transmitted together with the startup signal.

The paper post-processing device 200 transmits a conveyance-drive start signal to the mailbox 300 (Step S3). The mailbox 300 having received the conveyance-drive start signal is also activated, and the drive unit thereof is driven at the same paper conveyance speed (for example, 360 [mm/s]) as that of the main unit 100. The paper conveyance speed of the main unit 100 can be ascertained by the mailbox 300 based on speed information transmitted together with the conveyance-drive start signal.

The paper S discharged from the main unit 100 passes through the inlet guide plate 201 of the paper post-processing device 200, and is carried into the paper post-processing device 200 by the inlet roller pair 202 driven at the same paper conveyance speed as that of the main unit 100. Accordingly, the front edge of the paper S is guided to the upper conveyance path 210 by the branching claw 211, and passes through the conveyance roller pair 212 driven at the same paper conveyance speed as that of the main unit 100. The front edge of the paper S is fed to the conveyance path 310 toward the mailbox 300 by the branching claw 311 while being applied with a conveying force also from the conveyance roller pair 212, and passes through the conveyance roller pair 301 driven at the same paper conveyance speed as that of the main unit 100. At this time, the paper S is held by the inlet roller pair 202, the conveyance roller pair 212, and the conveyance roller pair 301 driven at the same conveyance speed, and conveyed by the conveying force applied from these roller pairs.

When a rear end of the paper S is detected by an inlet sensor 501 provided on an upstream side in the paper conveyance direction of the inlet roller pair 202 (Step S4), the paper post-processing device 200 transmits a conveyance-drive stop signal to the mailbox 300 (Step S5). Upon reception of the conveyance-drive stop signal, the mailbox 300 executes a conveyance stop control to stop conveyance drive of the drive unit thereof. In the present embodiment, a stepping motor, which is a synchronous motor, is adopted for the conveyance drive motor 370 that drives the conveyance roller pair 301 of the mailbox 300. Accordingly, the CPU 350 of the mailbox 300 executes the conveyance stop control to exhibit appropriate deceleration characteristics so that the stepping motor does not lose steps.

During a period from start of deceleration of the conveyance roller pair 301 of the mailbox 300 until stop thereof, the paper S is in a state held by the conveyance roller pair 301 of the mailbox 300 and the conveyance roller pair 212 of the paper post-processing device 200. When a stepping motor is adopted also to the conveyance drive motor 2942 that drives the conveyance roller pair 212 of the paper post-processing device 200 as in the conveyance drive motor 370, a conveyance-drive stop signal can be transmitted to the mailbox 300, so that drive of the conveyance roller pair 212 can be stopped. In this case, both the conveyance roller pairs 301 and 212 start deceleration at the same drive stop timing and the drive thereof is eventually stopped while exhibiting the same deceleration characteristics. Therefore, there is no occurrence of slackening or pulling of the paper portion between the conveyance roller pairs 301 and 212.

Figure 5:
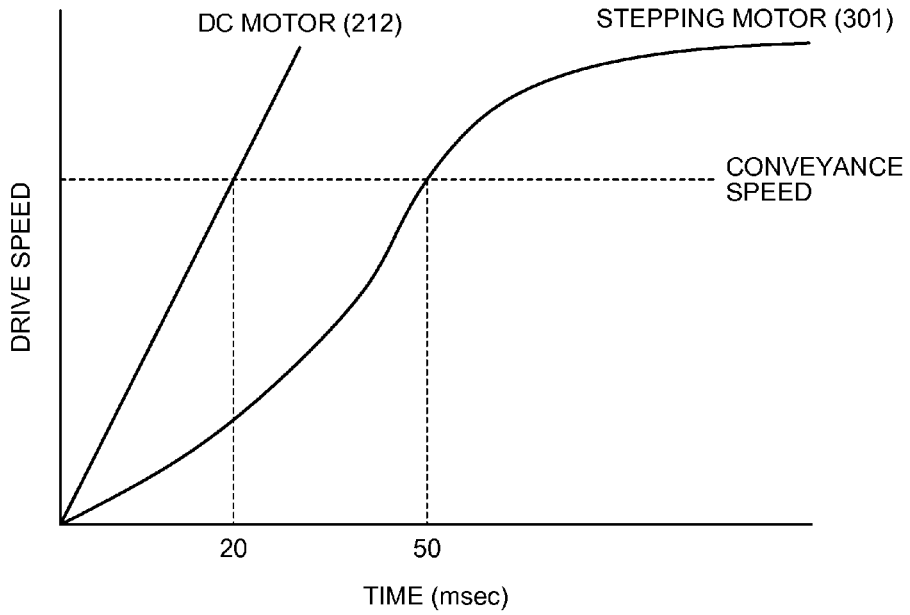
FIG. 5 is a graph of acceleration characteristics of a DC motor that drives a conveyance roller pair of the paper post-processing device and a stepping motor that drives a conveyance roller pair of the mailbox.

However, in the present embodiment, a DC motor, which is an asynchronous motor, is adopted to the conveyance drive motor 2942 that drives the conveyance roller pair 212 of the paper post-processing device 200. Therefore, the deceleration characteristics thereof are considerably different from those of the stepping motor adopted for the conveyance drive motor 370. FIG. 5 is a graph of acceleration characteristics of a DC motor that drives the conveyance roller pair 212 of the paper post-processing device 200 and a stepping motor that drives the conveyance roller pair 301 of the mailbox 300. The deceleration characteristics of the DC motor and the stepping motor are the same as the acceleration characteristics thereof, only the time of the acceleration characteristics is reversed.

Because the deceleration characteristics of the DC motor and the stepping motor are considerably different from each other, when deceleration of both the conveyance roller pairs 301 and 212 is started at the same drive stop timing, the length of the paper to be fed until the respective conveyance roller pairs 301 and 212 completely stop becomes considerably different. The conveyance roller pair 301 on a downstream side in the paper conveyance direction is a stepping motor having small deceleration (the length of the paper to be fed until stop is long), and the conveyance roller pair 301 on an upstream side in the paper conveyance direction is a DC motor having large deceleration (the length of the paper to be fed until stop is short). Therefore, the paper portion between the conveyance roller pairs 301 and 212 becomes an excessively pulled state.

Figure 6A:
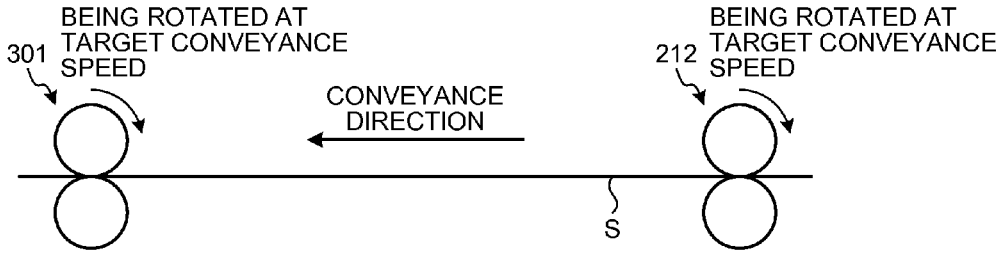
FIG. 6A is an explanatory diagram of a state of paper when a DC motor and a stepping motor are driven at a target conveyance speed.
Figure 6B:
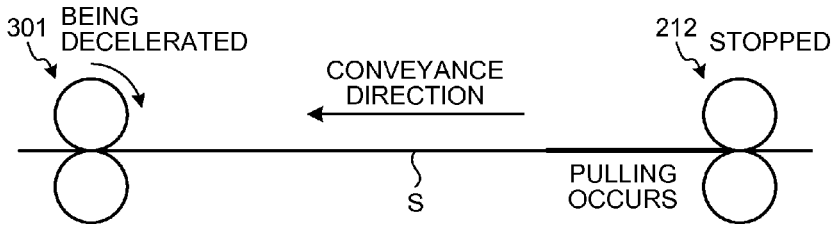
FIG. 6B is an explanatory diagram of a state of paper when deceleration of the DC motor and the stepping motor is started at the same drive stop timing.

In short, when the DC motor and the stepping motor are driven at a target conveyance speed, as shown in FIG. 6A, the paper S is appropriately conveyed without causing any excessive slackening or pulling in the paper portion between the conveyance roller pairs 301 and 212. However, when deceleration of the DC motor and the stepping motor is started at the same drive stop timing, as shown in FIG. 6B, after the DC motor is stopped, the stepping motor continues rotation for a while. As a result, excessive pulling occurs in the paper portion between the conveyance roller pairs 301 and 212, thereby causing damage and positional displacement of the paper S.

Therefore, in the present embodiment, a control is executed so that the drive stop timing of the DC motor is retarded than that of the stepping motor, while taking into consideration the deceleration characteristics of the stepping motor with respect to the DC motor (rotation information at the time of deceleration). Specifically, as shown in FIG. 5, according to the deceleration characteristics of the DC motor, the time from start of deceleration of the DC motor driven at the paper conveyance speed until stop thereof is 20 [ms]. Meanwhile, according to the deceleration characteristics of the stepping motor, the time from start of deceleration of the stepping motor driven at the paper conveyance speed until stop thereof is 50 [ms].

Therefore, according to the present embodiment, deceleration of the DC motor is started after a waiting time of 30 [ms] has elapsed since transmission of a conveyance-drive stop signal to the mailbox 300, using a time difference from deceleration start until stop as a reference. Specifically, an elapsed time from transmission of the conveyance-drive stop signal to the mailbox 300 is measured by a timer (Step S6), and a control is executed such that, after the timer has passed 30 [ms] (Step S7), drive stop of the DC motor is started to stop drive of the conveyance roller pair 212 (Step S8). By executing such a control to retard the drive stop timing of the DC motor than that of the stepping motor, pulling of the paper portion between the conveyance roller pairs 301 and 212 can be relaxed, as compared to a case where the drive stop timings of both motors are the same.

More specifically, because only the conveyance roller pair 301 driven by the stepping motor starts deceleration first, the paper portion between the conveyance roller pairs 301 and 212 gradually becomes a slackened state. Thereafter, the conveyance roller pair 212 driven by the DC motor starts deceleration, thereby gradually removing slackening of the paper portion between the conveyance roller pairs 301 and 212. Both the conveyance roller pairs 301 and 212 eventually stop substantially simultaneously, and at a point in time when the conveyance roller pairs 301 and 212 stop, the paper portion between the conveyance roller pairs 301 and 212 becomes a slightly slackened state (an appropriately slackened state), and excessive slackening or pulling does not occur.

By such a conveyance-drive stop control, the paper S stops at a punching position shown in FIG. 1. Thereafter, a clutch that transmits a driving force of the drive motor to a rotation shaft of the press punching device 502 is turned on to perform punching by the press punching device 502 (Step S9). During this period, at least the conveyance roller pairs 301 and 212 that hold the paper S therebetween are stopped. However, the inlet drive unit that drives the inlet roller pair 202 is conveyance-driven for receiving the subsequent paper, and the paper-discharge drive unit is conveyance-driven for completely discharging the preceding paper.

Figure 7:
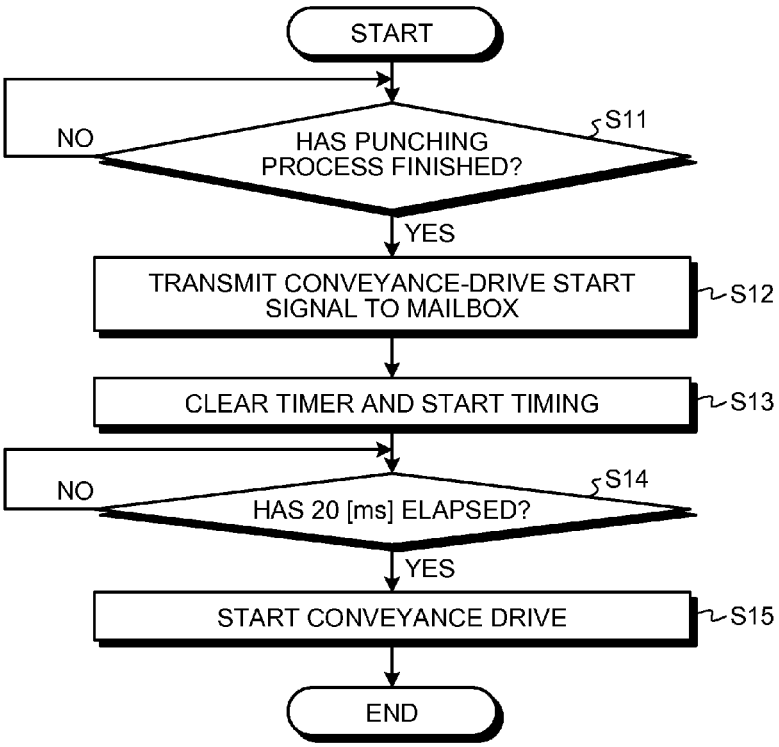
FIG. 7 is a flowchart of a control flow in the paper post-processing device in the embodiment since a punching process is performed on paper until the paper is discharged.

FIG. 7 is a flowchart of a control flow in the paper post-processing device 200 since a punching process is performed on the paper S until the paper S is discharged.

When the punching process finishes (Step S11), drive of both the conveyance roller pairs 301 and 212 that hold the paper S therebetween is restarted, and the paper S is discharged to a predetermined paper discharge tray of the mailbox 300. At this time, the acceleration characteristics of the DC motor and the stepping motor that respectively drive the conveyance roller pairs 301 and 212 is considerably different as shown in FIG. 5. Therefore, when acceleration of both the conveyance roller pairs 301 and 212 is started at the same drive start timing, the length of the paper to be fed until both the conveyance roller pairs 301 and 212 reach the paper conveyance speed becomes considerably different. As a result, in the present embodiment, the paper portion between the conveyance roller pairs 301 and 212 becomes an excessively slackened state.

Figure 8:
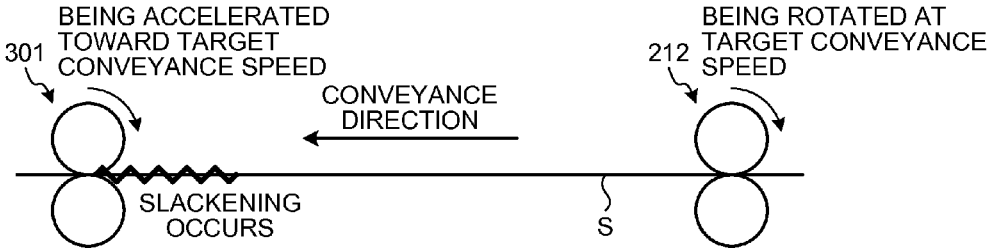
FIG. 8 is an explanatory diagram of a state of paper when the DC motor and the stepping motor are driven at the same drive start timing.

In short, when the DC motor and the stepping motor are driven at the same drive start timing, because acceleration of the DC motor is large, as shown in FIG. 8, even if the DC motor has reached the target conveyance speed, the stepping motor is still in acceleration toward the target conveyance speed. That is, the paper conveyance speed of the conveyance roller pair 212 always exceeds the paper conveyance speed of the conveyance roller pair 301, until the stepping motor reaches the target conveyance speed. Accordingly, excessive slackening occurs in the paper portion between the conveyance roller pairs 301 and 212, thereby causing damage and positional displacement of the paper S.

Therefore, in the present embodiment, a control is executed so that the drive start timing of the DC motor is retarded than that of the stepping motor, while taking into consideration the acceleration characteristics of the stepping motor with respect to the DC motor (rotation information at the time of acceleration). Specifically, acceleration of the DC motor is started after a waiting time of 20 [ms] has elapsed since transmission of a conveyance-drive start signal to the mailbox 300, using a slackened amount of the paper portion between the conveyance roller pairs 301 and 212 before start of drive and a time difference from acceleration start until the target paper conveyance speed has reached as a reference. Specifically, an elapsed time from transmission of the conveyance-drive start signal to the mailbox 300 is measured by the timer (Step S13), and a control is executed such that, after the timer has passed 20 [ms] (Step S14), drive of the DC motor is started to start drive of the conveyance roller pair 212 (Step S15). By executing such a control to retard the drive start timing of the DC motor than that of the stepping motor, slackening of the paper portion between the conveyance roller pairs 301 and 212 can be relaxed, as compared to a case where the drive start timings of both motors are the same.

More specifically, before drive of the conveyance roller pairs 301 and 212 is restarted, as described above, the paper portion between the conveyance roller pairs 301 and 212 is in a slightly slackened state. In this state, by starting acceleration of only the conveyance roller pair 301 driven by the stepping motor, slackening of the paper portion between the conveyance roller pairs 301 and 212 is gradually resolved. Thereafter, by starting acceleration of the conveyance roller pair 212 driven by the DC motor, slackening is generated in the paper portion between the conveyance roller pairs 301 and 212. When both the conveyance roller pairs 301 and 212 eventually reach the target paper conveyance speed, the paper portion between the conveyance roller pairs 301 and 212 becomes a slightly slackened state (an appropriately slackened state), and excessive slackening or pulling does not occur.

First Modification

A modification of the paper-conveyance drive control according to the present embodiment (hereinafter, "first modification") is explained next.

In the first modification, when two or more types of the paper conveyance speed are present due to a difference in an operation mode of the image forming apparatus 100, a waiting time is changed according to the conveyance speed of paper discharged from the image forming apparatus 100.

Figure 9:
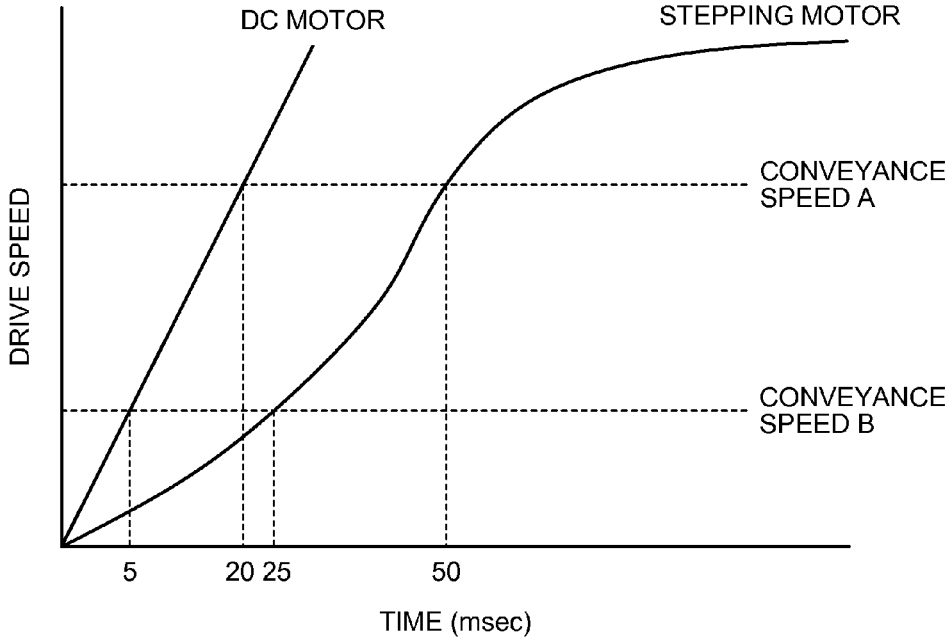
FIG. 9 is a graph of acceleration characteristics of the DC motor and the stepping motor until these motors reach conveyance speeds A and B.

FIG. 9 is a graph of acceleration characteristics of the DC motor and the stepping motor until these motors reach conveyance speeds A and B. Deceleration characteristics of the DC motor and the stepping motor are the same as the acceleration characteristics thereof, only the time of the acceleration characteristics is reversed.

As shown in FIG. 9, according to the acceleration characteristics of the DC motor, the time from start of acceleration until the DC motor reaches the high-speed paper conveyance speed A is 20 [ms], and the time from start of acceleration until the DC motor reaches the low-speed paper conveyance speed B is 5 [ms]. Meanwhile, according to the acceleration characteristics of the stepping motor, the time from start of acceleration until the stepping motor reaches the high-speed paper conveyance speed A is 50 [ms], and the time from start of acceleration until the stepping motor reaches the low-speed paper conveyance speed B is 25 [ms]. Therefore, a time difference from start of acceleration until the target conveyance speed has reached between the DC motor and the stepping motor is 30 [ms] in the case of the target conveyance speed being the high-speed paper conveyance speed A, and 20 [ms] in the case of the target conveyance speed being the low-speed paper conveyance speed B. Due to the difference, when the same waiting time is adopted both in the paper conveyance speed A and the paper conveyance speed B, excessive slackening or pulling may occur in at least one of the paper conveyance speeds. The same applies to the deceleration.

Figure 10:
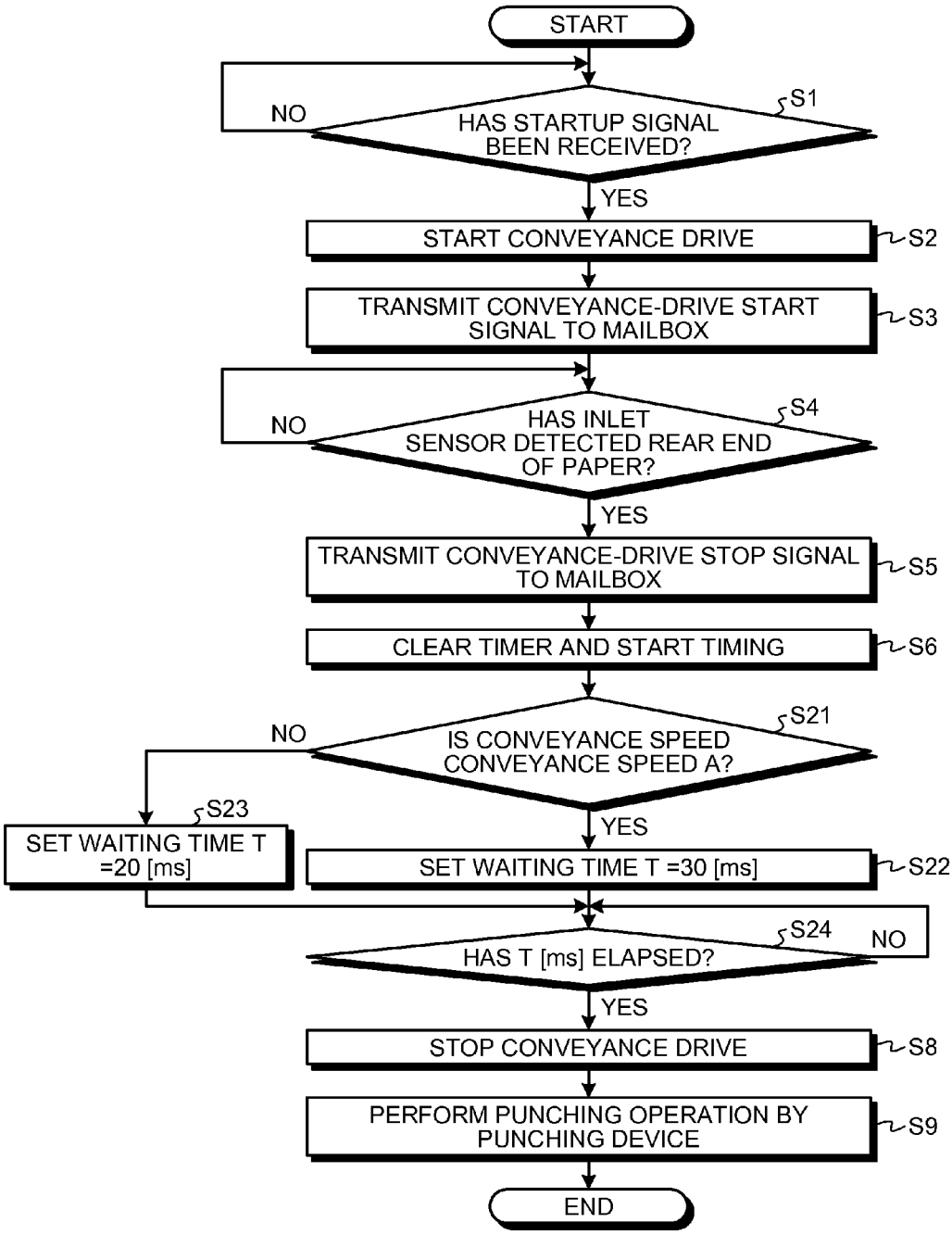
FIG. 10 is a flowchart of a control flow in the paper post-processing device in a first modification until a punching process is performed on paper.

FIG. 10 is a flowchart of a control flow in the paper post-processing device 200 in the first modification until a punching process is performed on the paper S.

In the first modification, when a rear end of the paper S is detected by the inlet sensor 501 provided on an upstream side in the paper conveyance direction of the inlet roller pair 202 (Step S4), the paper post-processing device 200 transmits a conveyance-drive stop signal to the mailbox 300 (Step S5), as in the embodiment described above. Accordingly, the CPU 350 of the mailbox 300 executes a conveyance stop control to exhibit appropriate deceleration characteristics so that the stepping motor does not lose steps.

In the first modification, a time difference from start of deceleration until stop is different between the DC motor and the stepping motor according to a difference of the target conveyance speeds. When the target conveyance speed is the high-speed paper conveyance speed A (YES at Step S21), the waiting time T is set to 30 [ms], using the time difference in this case as a reference (Step S22). On the other hand, when the target conveyance speed is the low-speed paper conveyance speed B (NO at Step S21), the waiting time T is set to 20 [ms], using the time difference in this case as a reference (Step S23). When the timer that measures the elapsed time since transmission of the conveyance-drive stop signal to the mailbox 300 has passed the set waiting time T (Step S24), the CPU 350 executes a control to start drive stop of the DC motor, thereby stopping the drive of the conveyance roller pair 212 (Step S8).

By executing such a control to retard the drive stop timing of the DC motor than that of the stepping motor, excessive slackening or pulling does not occur in the paper portion between the conveyance roller pairs 301 and 212, in either of the conveyance speeds A and B, and the paper S can be stopped in a slightly slackened state (an appropriately slackened state).

Figure 11:
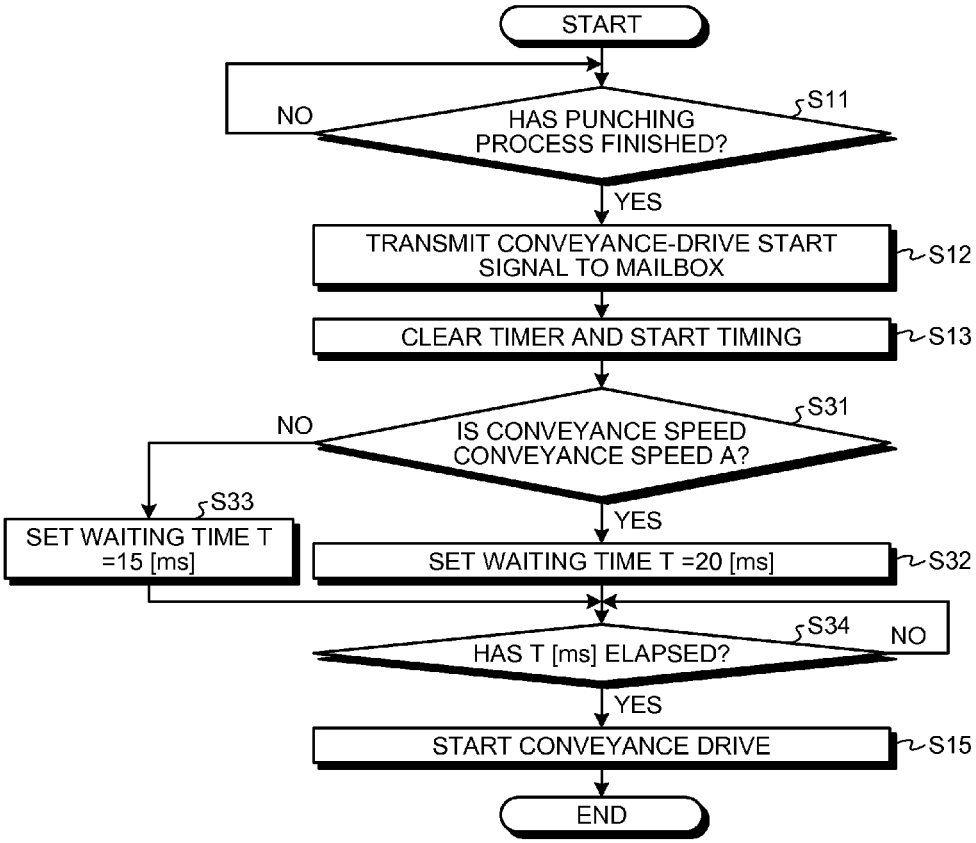
FIG. 11 is a flowchart of a control flow in the paper post-processing device since a punching process is performed on the paper in the first modification until the paper is discharged.

FIG. 11 is a flowchart of a control flow in the paper post-processing device 200 since a punching process is performed on the paper S in the first modification until the paper S is discharged.

When the punching process is finished (Step S11), the elapsed time from transmission of the conveyance-drive start signal to the mailbox 300 is measured by the timer (Step S13). At this time, a time difference from start of acceleration until the target conveyance speed has reached between the DC motor and the stepping motor is different according to a difference of the target conveyance speeds. Accordingly, when the target conveyance speed is the high-speed paper conveyance speed A (YES at Step S31), the waiting time T is set to 20 [ms], using the time difference in this case as a reference (Step S32). On the other hand, when the target conveyance speed is the low-speed paper conveyance speed B (NO at Step S31), the waiting time T is set to 15 [ms], using the time difference in this case as a reference (Step S33). When the timer that measures the elapsed time since transmission of the conveyance-drive start signal to the mailbox 300 has passed the set waiting time T (Step S34), the CPU 350 executes a control to start drive of the DC motor, thereby starting the drive of the conveyance roller pair 212 (Step S15).

By executing such a control to retard the drive start timing of the DC motor than that of the stepping motor, excessive slackening or pulling does not occur in the paper portion between the conveyance roller pairs 301 and 212, in either of the conveyance speeds A and B.

Second Modification

Another modification of the paper-conveyance drive control according to the present embodiment (hereinafter, "second modification") is explained next.

In the second modification, when the position of a punch hole to be bored in the paper S by the punching process is adjustable by a user's instruction, a waiting time is changed according to an adjustment value Ad corresponding to a difference of the punch hole position. The basic control flow is the same as that of the first modification.

Figure 12:
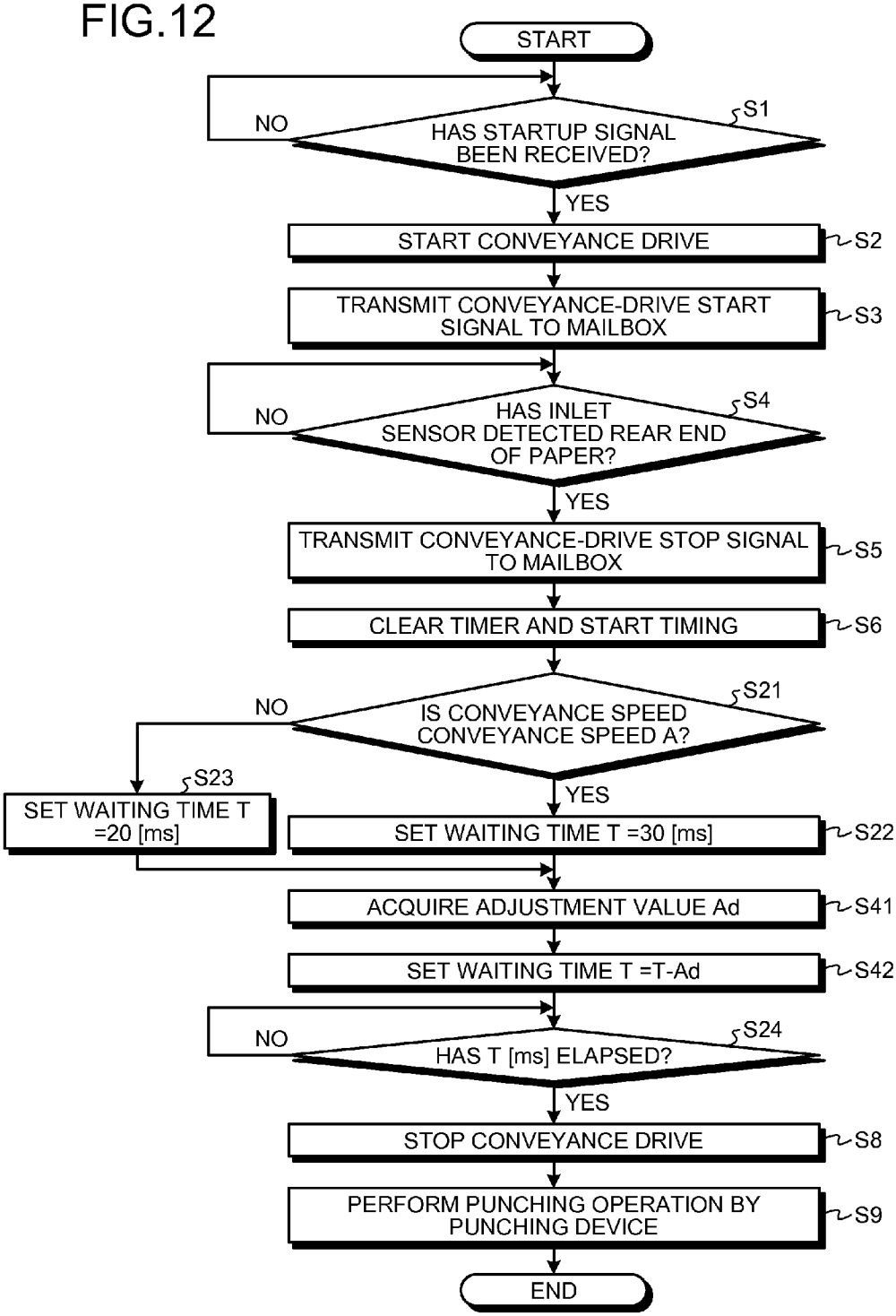
FIG. 12 is a flowchart of a control flow in the paper post-processing device in a second modification until a punching process is performed on paper.

FIG. 12 is a flowchart of a control flow in the paper post-processing device 200 until a punching process is performed on the paper S.

In the second modification, when a rear end of the paper S is detected by the inlet sensor 501 provided on an upstream side in the paper conveyance direction of the inlet roller pair 202 (Step S4), the paper post-processing device 200 transmits a conveyance-drive stop signal to the mailbox 300 (Step S5), as in the embodiment described above. Accordingly, the CPU 350 of the mailbox 300 executes a conveyance stop control to exhibit appropriate deceleration characteristics so that the stepping motor does not lose steps. The waiting time T is set according to a difference of the target conveyance speeds, while taking into consideration that the time difference from start of deceleration until stop is different between the DC motor and the stepping motor according to a difference of the target conveyance speeds (Step S21 to Step S23).

Because a punch hole by the punching process is bored at the rear end of the paper S, the position of the punch hole is determined based on a position where the rear end of the paper S stops. The stop position of the rear end of the paper S is determined based on a stop timing of the conveyance roller pair 212 of the paper post-processing device 200 driven by the DC motor. In the embodiment and the first modification described above, the waiting time T for determining the stop timing of the conveyance roller pair 212 is set so that the rear end of the paper S stops at a position where the paper S is supposed to be stopped when the punch hole is bored at a standard position on the paper S (a standard punching position). However, when the position at which the punch hole is bored is shifted from the standard position according to a user's instruction or the like, the punching position at which the paper S is supposed to be stopped needs to be shifted from the standard punching position.

Therefore, in the second modification, after the waiting time T is set according to a difference of the target conveyance speeds (Step S21 to Step S23), the waiting time adjustment value Ad according to a shift amount of the punching position at which the paper S is supposed to be stopped from the standard punching position is acquired based on setting information of the position to bore the punch hole according to the user's instruction or the like (Step S41). A value obtained by subtracting the adjustment value Ad from the waiting time T set at Step S22 or S23 described above is newly set as the waiting time T (Step S42). However, when the target conveyance speed is different, even if the punching position according to the user's instruction is the same, the adjustment value Ad to be used for adjustment of the waiting time T becomes different as shown in FIG. 13.

When the timer that measures the elapsed time since transmission of the conveyance-drive stop signal to the mailbox 300 has passed the waiting time T set in this manner (Step S24), the CPU 350 executes a control to start drive stop of the DC motor, thereby stopping the drive of the conveyance roller pair 212 (Step S8). By executing such a control to adjust the waiting time T, the paper S can be appropriately stopped at the punching position, which changes according to the user's instruction. Regarding the waiting time when conveyance of the paper S is restarted after the punching process is performed on the paper S, because adjustment by using the adjustment value Ad is not required, the same control as that of the first modification can be executed.

The above embodiment and modifications are only examples of the present invention, and the present invention has unique effects in each mode as described below.

Mode A

A sheet conveying apparatus includes a first sheet conveying unit such as the conveyance roller pair 212 that conveys a sheet such as the paper S by a driving force of an asynchronous motor such as a DC motor, and a second sheet conveying unit such as the conveyance roller pair 301 that conveys a sheet by a driving force of a synchronous motor such as a stepping motor, and transfers a sheet from one of the first sheet conveying unit and the second sheet conveying unit to the other one to convey the sheet. The sheet conveying apparatus has an asynchronous-motor control unit such as the CPU 291 that starts drive of the asynchronous motor at a drive start timing determined according to rotation information at the time of acceleration, such as acceleration characteristics of the synchronous motor, at the time of starting sheet conveyance when the same sheet is conveyed by both the first sheet conveying unit and the second sheet conveying unit.

According to this mode, in the acceleration period until both the synchronous motor and the asynchronous motor rotate in a steady state, occurrence of excessive slackening or pulling in a sheet portion between the first sheet conveying unit and the second sheet conveying unit can be suppressed.

Mode B

A sheet conveying apparatus includes a first sheet conveying unit such as the conveyance roller pair 212 that conveys a sheet such as the paper S by a driving force of an asynchronous motor such as a DC motor, and a second sheet conveying unit such as the conveyance roller pair 301 that conveys a sheet by a driving force of a synchronous motor such as a stepping motor, and transfers a sheet from one of the first sheet conveying unit and the second sheet conveying unit to the other one to convey the sheet. The sheet conveying apparatus has an asynchronous-motor control unit such as the CPU 291 that stops drive of the asynchronous motor at a drive stop timing determined according to rotation information at the time of deceleration of the synchronous motor, at the time of stopping sheet conveyance when the same sheet is conveyed by both the first sheet conveying unit and the second sheet conveying unit.

According to this mode, in the deceleration period until both the synchronous motor and the asynchronous motor change from the steady state to a stopped state, occurrence of excessive slackening or pulling in the sheet portion between the first sheet conveying unit and the second sheet conveying unit can be suppressed.

Mode C

In the mode A or B described above, the drive start timing or the drive stop timing is determined also according to the sheet conveyance speed, which is the target conveyance speed.

According to this mode, as explained in the first modification, also in a different sheet conveyance speed, occurrence of excessive slackening or pulling in the sheet portion between the first sheet conveying unit and the second sheet conveying unit can be suppressed.

Mode D

In the mode C described above, the asynchronous-motor control unit acquires the sheet conveyance speed from a drive control unit such as the main unit's CPU 110 that controls drive of a third sheet conveying unit such as the paper-discharge roller pair 101 that conveys a sheet on an upstream side in the sheet conveyance direction of the first sheet conveying unit and the second sheet conveying unit.

According to this mode, the sheet conveyance speed can be ascertained in advance.

Mode E

In any one of the modes A to D described above, a sheet is transferred from the first sheet conveying unit to the second sheet conveying unit.

According to this mode, occurrence of excessive slackening or pulling can be suppressed in a configuration in which the first sheet conveying unit driven by an asynchronous motor is arranged on the upstream side in the sheet conveyance direction of the second sheet conveying unit driven by a synchronous motor.

Mode F

In any one of the modes A to E described above, the synchronous motor is a stepping motor.

According to this mode, the position of a sheet conveyed by the second sheet conveying unit can be controlled highly accurately by a general control.

Mode G

In any one of the modes A to E described above, the asynchronous motor is a direct-current motor.

According to this mode, the manufacturing cost can be reduced by using an inexpensive direct-current motor for the asynchronous motor.

Mode H

In an image forming system including the image forming apparatus 100 that forms an image on a sheet such as the paper S, and a sheet conveying apparatus that conveys a sheet discharged from the image forming apparatus, such as the paper post-processing device 200 and the mailbox 300, the sheet conveying apparatus according to any one of the modes A to G described above is used as the sheet conveying apparatus.

According to this mode, because excessive slackening or pulling does not occur in a sheet portion between the first sheet conveying unit and the second sheet conveying unit, such a problem that a sheet formed with an image is damaged can be suppressed.

In the present embodiments, at the time of starting conveyance of a sheet spanned between the first sheet conveying unit and the second sheet conveying unit, drive of the asynchronous motor is started at the drive start timing determined according to rotation information at the time of acceleration of the synchronous motor. Generally, because acceleration of the synchronous motor is larger than that of the asynchronous motor, the drive start timing of the synchronous motor is retarded than that of the asynchronous motor. Accordingly, although slight slackening or pulling may occur due to a difference in acceleration characteristics of these motors in an acceleration period until both the synchronous motor and the asynchronous motor rotate in a steady state, occurrence of excessive slackening or pulling can be suppressed.

According to the above configuration, the present embodiments can achieve a significant effect such that it is possible to suppress excessive slackening or pulling of a sheet conveyed while being spanned between two sheet conveying units, respectively adopting a synchronous motor and an asynchronous motor.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet conveying apparatus comprising:

a first sheet conveying unit to convey a sheet by a driving force of an asynchronous motor;

a second sheet conveying unit to convey a sheet by a driving force of a synchronous motor, wherein a sheet is transferred from one of the first sheet conveying unit and the second sheet conveying unit to the other one to convey the sheet; and an asynchronous-motor control unit to start drive of the asynchronous motor at a drive start timing determined according to a sheet conveyance speed and according to rotation information at a time of acceleration of the synchronous motor, at a time of starting sheet conveyance when a same sheet is conveyed by both the first sheet conveying unit and the second sheet conveying unit, the asynchronous-motor control unit being further configured to acquire the sheet conveyance speed from a drive control unit configured to control drive of a third sheet conveying unit configured to convey a sheet on an upstream side in a sheet conveyance direction of the first sheet conveying unit and the second sheet conveying unit.

2. The sheet conveying apparatus according to claim 1, wherein a sheet is transferable from the first sheet conveying unit to the second sheet conveying unit.

3. The sheet conveying apparatus according to claim 1, wherein the synchronous motor is a stepping motor.

4. The sheet conveying apparatus according to claim 1, wherein the asynchronous motor is a direct-current motor.

5. An image forming system according to claim 1, the image forming system comprising:

an image forming apparatus that forms an image on a sheet; and the sheet conveying apparatus of claim 1, wherein the sheet conveying apparatus conveys a sheet discharged from the image forming apparatus.

6. A sheet conveying apparatus comprising:

a first sheet conveying unit to convey a sheet by a driving force of an asynchronous motor;

a second sheet conveying unit to convey a sheet by a driving force of a synchronous motor, wherein a sheet is transferrable from one of the first sheet conveying unit and the second sheet conveying unit to the other one to convey the sheet; and an asynchronous-motor control unit to stop drive of the asynchronous motor at a drive stop timing determined according to a sheet conveyance speed and according to rotation information at a time of deceleration of the synchronous motor, at a time of stopping sheet conveyance when a same sheet is conveyed by both the first sheet conveying unit and the second sheet conveying unit, the asynchronous-motor control unit being further configured to acquire the sheet conveyance speed from a drive control unit configured to control drive of a third sheet conveying unit configured to convey a sheet on an upstream side in a sheet conveyance direction of the first sheet conveying unit and the second sheet conveying unit.

7. The sheet conveying apparatus according to claim 6, wherein a sheet is transferrable from the first sheet conveying unit to the second sheet conveying unit.

8. The sheet conveying apparatus according to claim 6, wherein the synchronous motor is a stepping motor.

9. The sheet conveying apparatus according to claim 6, wherein the asynchronous motor is a direct-current motor.

10. An image forming system according to claim 6, the image forming system comprising:

an image forming apparatus that forms an image on a sheet; and the sheet conveying apparatus of claim 6, wherein the sheet conveying apparatus is configured to convey a sheet discharged from the image forming apparatus.

* * * * *